US010262790B2

(12) United States Patent
Diao

(10) Patent No.: US 10,262,790 B2
(45) Date of Patent: Apr. 16, 2019

(54) PERMANENT MAGNET DRIVE ON-LOAD TAP-CHANGING SWITCH

(71) Applicant: Junqi Diao, Jinan (CN)

(72) Inventor: Junqi Diao, Jinan (CN)

( * ) Notice: Subject to any disclaimer, the term of this patent is extended or adjusted under 35 U.S.C. 154(b) by 38 days.

(21) Appl. No.: 15/540,540

(22) PCT Filed: Jan. 28, 2015

(86) PCT No.: PCT/CN2015/071702

§ 371 (c)(1),
(2) Date: Jun. 28, 2017

(87) PCT Pub. No.: WO2016/106920

PCT Pub. Date: Jul. 7, 2016

(65) Prior Publication Data

US 2018/0005753 A1 Jan. 4, 2018

(30) Foreign Application Priority Data

Dec. 29, 2014 (CN) ..... 2014 1 0832001

(51) Int. Cl.
*H01H 67/02* (2006.01)
*H01F 29/04* (2006.01)
(Continued)

(52) U.S. Cl.
CPC ..... *H01F 29/04* (2013.01); *H01H 1/56* (2013.01); *H01H 9/0016* (2013.01); *H01H 36/0073* (2013.01)

(58) Field of Classification Search
CPC .. H01H 1/56; H01H 1/48; H01H 3/28; H01H 9/0016; H01H 36/007; H01H 9/00; H01F 29/04; H01F 7/0242
(Continued)

(56) References Cited

U.S. PATENT DOCUMENTS 2,447,634 A * 8/1948 Carlin ..... G05F 1/147 318/447
3,112,438 A * 11/1963 Buhler ..... H01F 29/04 323/341
2014/0167529 A1* 6/2014 Teising ..... H01H 9/0027 307/134

FOREIGN PATENT DOCUMENTS

CN 201051476 Y 4/2008
CN 201397763 Y 2/2010
CN 203119860 U 8/2013

OTHER PUBLICATIONS

Oct. 9, 2015 International Search Report issued in International Patent Application No. PCT/CN2015/071702.

* cited by examiner

*Primary Examiner* — Shawki S Ismail
*Assistant Examiner* — Lisa N Homza
(74) *Attorney, Agent, or Firm* — Oliff PLC

(57) ABSTRACT

A permanent magnet drive on-load tap-changing switch including a changing switch circuit that includes structurally identical odd- and even-numbered tap-changing circuits. The circuits include working contactors and dual-contact synchronous transition contactors made of primary and secondary contactors. The contactors each face directly a moving contactor, which are connected in parallel. A permanent magnet is fixed on each moving contactor and face directly on the other extremity thereof a moving contactor driving mechanism. The mechanism changes a force applied to the magnets, allowing the moving contactors to come into contact with or be separated from the working and transition contactors, thus implementing changeover from one tap to another tap. The switch is structurally simple and convenient to use, obviates the need for a high-speed mechanism, implements changing by the direct actions of the contactors,
(Continued)

operates at high speed and reliably, and has a low failure rate and an extended service life.

2 Claims, 8 Drawing Sheets

(51) Int. Cl.
*H01H 1/56* (2006.01)
*H01H 9/00* (2006.01)
*H01H 36/00* (2006.01)
(58) Field of Classification Search
USPC ..... 335/121
See application file for complete search history.

PERMANENT MAGNET DRIVE ON-LOAD TAP-CHANGING SWITCH

TECHNICAL FIELD

The invention relates to an on-load tap-changing switch, particularly a permanent magnet drive on-load tap-changing switch.

BACKGROUND TECHNOLOGY

Transformers change the turns per effective coil on the high voltage side of transformers through the switching from one tap to another tap to realize voltage adjustment. The on-load tap-changing switch switches the load current via a changing switch, and the high-speed mechanism is the power source of changing switch. At present, the high-speed mechanism mainly adopts a spring energy-releasing unit, but the reliability of spring is poor, and once the main spring is damaged, the whole will break down; as the use time extends, the elasticity of spring will gradually become poor or the spring will break off, which will cause serious consequences.

CONTENT OF INVENTION

As for the aforesaid problems, the invention provides a permanent magnet drive on-load tap-changing switch which needs no high-speed mechanism, directly acts via contactors, operates quickly and reliably and has a long service life.

In order to solve the aforesaid problems, the present invention adopts the following technical solutions: a permanent magnet drive on-load tap-changing switch, comprising a changing switch circuit, wherein the said changing switch circuit comprises an odd-numbered tap-changing circuit and an even-numbered tap-changing circuit that are structurally identical, wherein the tap-changing circuits are constituted by working contactors, and dual-contact synchronous transition contactors consisting of primary contactors and secondary contactors, and the working contactor is connected with the primary contactor by trigger transmitter and transition resistance, and a primary contactor of a tap-changing circuit is connected to the secondary contactor of another tap-changing circuit by a high-voltage thyristor, while the said trigger transmitter provides the high-voltage thyristor connected to the secondary contactor of the same tap-changing circuit with trigger current, and the said working contactors and the dual-contact synchronous transition contactors respectively correspond to a moving contactor. The moving contactors are connected in parallel to each other. Permanent magnets are fixed bijectively on the moving contactors. The permanent magnets face directly at the other extremity thereof a moving contactor driving mechanism. Wherein the moving contactor driving mechanism changes a force applied to the permanent magnets and thereby allowing the moving contactors to come into contact with or be separated from the working contactors and the transition contactors, thus implementing changeover from one tap to another tap. The moving contactor driving mechanism comprises a rotating permanent magnet and a magnetic conductor of which head pole is enveloped on one side of the rotating permanent magnet, while the tail pole of magnetic conductor is directly face to the permanent magnet. The magnetic conductor is arranged such that it is convenient to concentrate magnetic forces of rotating permanent magnet and enhance the acting force on the permanent magnet. The rotation of rotating permanent magnet changes the acting force on the permanent magnet, thereby allowing the moving contactors to come into contact with or be separated from the working contactors and the dual-contact synchronous transition contactors. When the rotating permanent magnet is close to the permanent magnet at the poles of same polarity, the rotating permanent magnet will produce a repelling force on the permanent magnet, and the moving contactor will contact with the working contactor/dual-contact synchronous transition contactor; when the rotating permanent magnet is close to the permanent magnet at the poles of different polarity, the rotating permanent magnet will produce an attracting force on the permanent magnet, and the moving contactor will separate from the working contactor/dual-contact synchronous transition contactor.

A permanent magnet drive on-load tap-changing switch, comprising a changing switch circuit, wherein the said changing switch circuit comprises an odd-numbered tap-changing circuit and an even-numbered tap-changing circuit that are structurally identical, wherein the tap-changing circuits are constituted by working contactors, and dual-contact synchronous transition contactors consisting of primary contactors and secondary contactors, and the working contactor is connected with the primary contactor by trigger transmitter and transition resistance, and a primary contactor of a tap-changing circuit is connected to the secondary contactor of another tap-changing circuit by a high-voltage thyristor, while the said trigger transmitter provides the high-voltage thyristor connected to the secondary contactor of the same tap-changing circuit with trigger current, the said working contactor and the said dual-contact synchronous transition contactor are connected to a permanent magnet on one side, while they are directly face to a moving contactor on the other side, and the moving contactors are connected in parallel to each other, while each moving contactor is connected to the moving contactor driving mechanism. Wherein the moving contactor driving mechanism changes a force applied to the permanent magnets and thereby allowing the moving contactors to come into contact with or be separated from the working contactors and the transition contactors, thus implementing changeover from one tap to another tap. The moving contactor driving mechanism comprises a rotating permanent magnet and a magnetic conductor of which head pole is enveloped on one side of the rotating permanent magnet, while the tail pole of magnetic conductor is directly face to the permanent magnet. The rotation of rotating permanent magnet changes the acting force on the permanent magnet, thereby allowing the moving contactors to come into contact with or be separated from the working contactors and the dual-contact synchronous transition contactors. When the rotating permanent magnet is close to the permanent magnet at the poles of same polarity, the rotating permanent magnet will produce a repelling force on the permanent magnet, and the moving contactor will separate from the working contactor/dual-contact synchronous transition contactors; when the rotating permanent magnet is close to the permanent magnet at the poles of different polarity, the rotating permanent magnet will produce an attracting force on the permanent magnet, and the moving contactor will contact with the working contactor/dual-contact synchronous transition contactors.

The invention is structurally simple and convenient to use, obviates the need for a high-speed mechanism, implements changing by means of direct actions of the contactors, operates at high speed and reliability, and has a low failure rate, an extended service life and the value for widespread use.

Wherein, 1. Moving contactor, 2. Permanent magnet, 3. Magnetic conductor, 4. Rotating permanent magnet D1-D4 are moving contactors, K1 and K2 are working contactors; R1 and R2 are transition resistors, k1, k1' and k2, k2' are dual-contact synchronous transition contactors, k1, k2 are primary contactors, k1', k2' are secondary contactors, TSCB1, TSCB2 are trigger transmitters, TSC1, TSC2 are high-voltage thyristors.

SPECIFIC EMBODIMENTS

Embodiment 1

Figure 1:
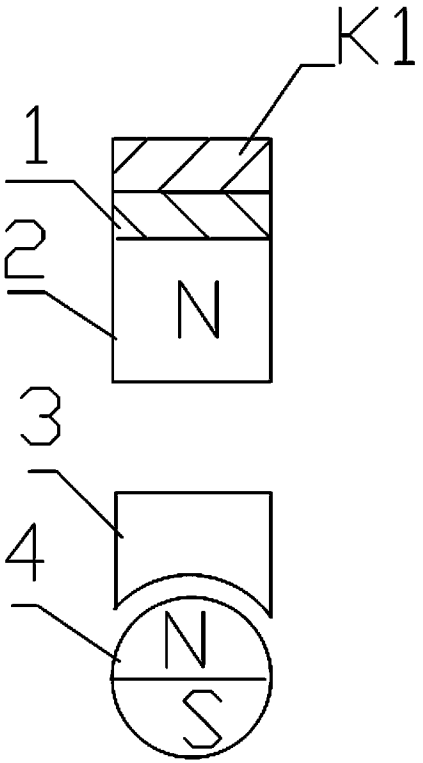
FIG. 1 is the schematic diagram of working principle of Embodiment 1.

A permanent magnet drive on-load tap-changing switch, as shown in FIG. 1, comprising a changing switch circuit, wherein the said changing switch circuit comprises an odd-numbered tap-changing circuit and an even-numbered tap-changing circuit that are structurally identical, wherein the tap-changing circuits are constituted by working contactors K1/K2, and dual-contact synchronous transition contactors k1, k1'/k2, k2' consisting of primary contactors k1/k2 and secondary contactors k1'/k2', and the working contactor K1/K2 is connected with the primary contactor k1/k2 by trigger transmitter TSCB1/TSCB2 and transition resistance R1/R2, the primary contactor k1 of the odd-numbered tap-changing circuit is connected to the secondary contactor k2' of the even-numbered tap-changing circuit by the high-voltage thyristor TSC2; the primary contactor k2 of even-numbered tap-changing circuit is connected to the secondary contactor k1' of the odd-numbered tap-changing circuit by the high-voltage thyristor TSC1. The said trigger transmitter TSCB1 provides the high-voltage thyristor TSC1 with trigger current; the said trigger transmitter TSCB2 provides the high-voltage thyristor TSC2 with trigger current. The said working contactors K1/K2 and the dual-contact synchronous transition contactors k1, k1'/k2, k2' respectively correspond to a moving contactor 1. The moving contactors 1 are connected in parallel to each other. Permanent magnets 2 are fixed bijectively on the moving contactors 1. The permanent magnets 2 face directly at the other extremity thereof a moving contactor driving mechanism. Wherein the moving contactor driving mechanism changes a force applied to the permanent magnets 2 and thereby allowing the moving contactors 1 to come into contact with or be separated from the working contactors K1/K2 and the dual-contact synchronous transition contactors k1, k1'/k2, k2', thus implementing changeover from one tap to another tap. The moving contactor driving mechanism comprises a rotating permanent magnet 4 and a magnetic conductor 3 of which head pole is enveloped on one side of the rotating permanent magnet 4, while the tail pole of magnetic conductor 3 is directly face to the permanent magnet 2.

Figure 3:
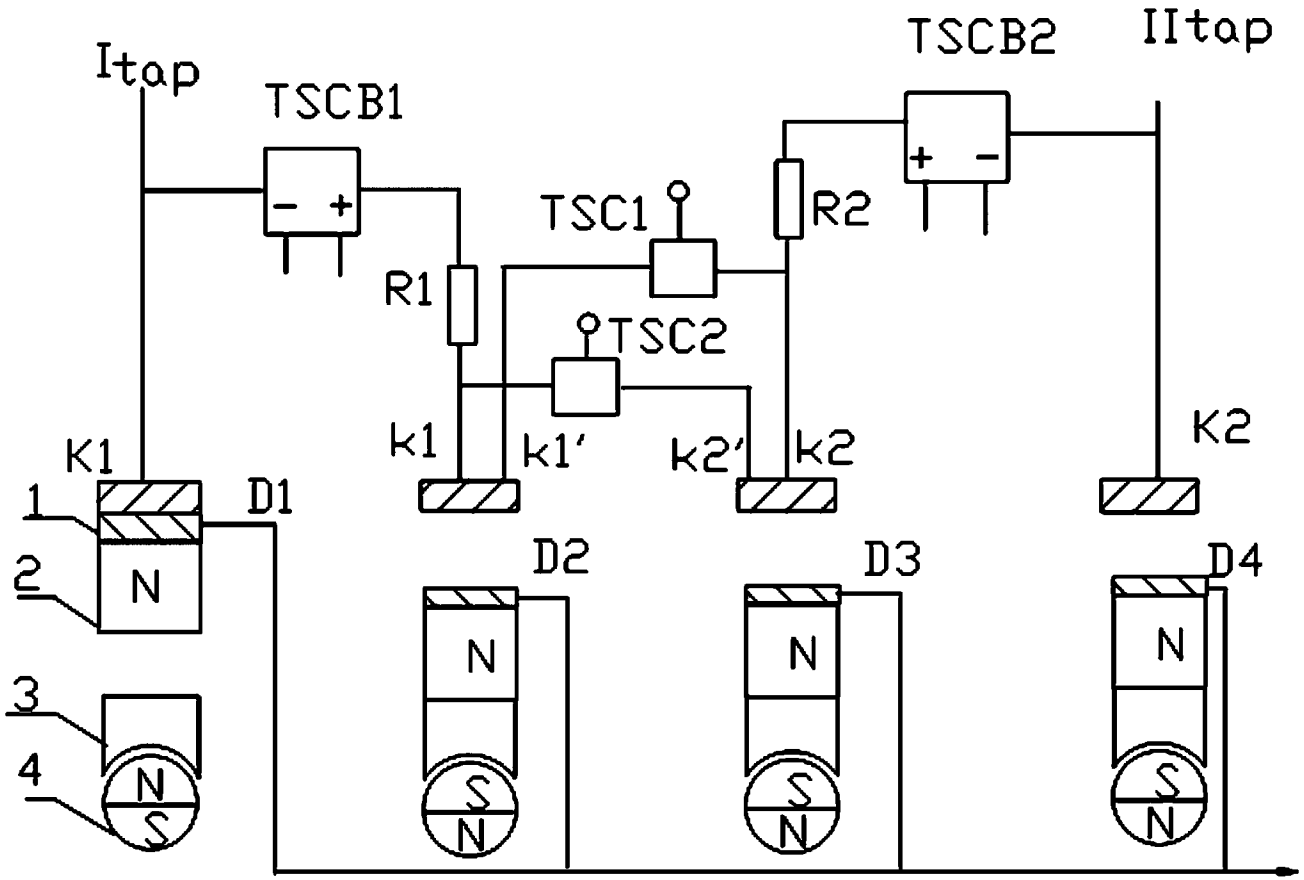
FIG. 3 is the schematic diagram of contacting of the moving contactor D1 with the working contactor K1 in Embodiment 1.
Figure 4:
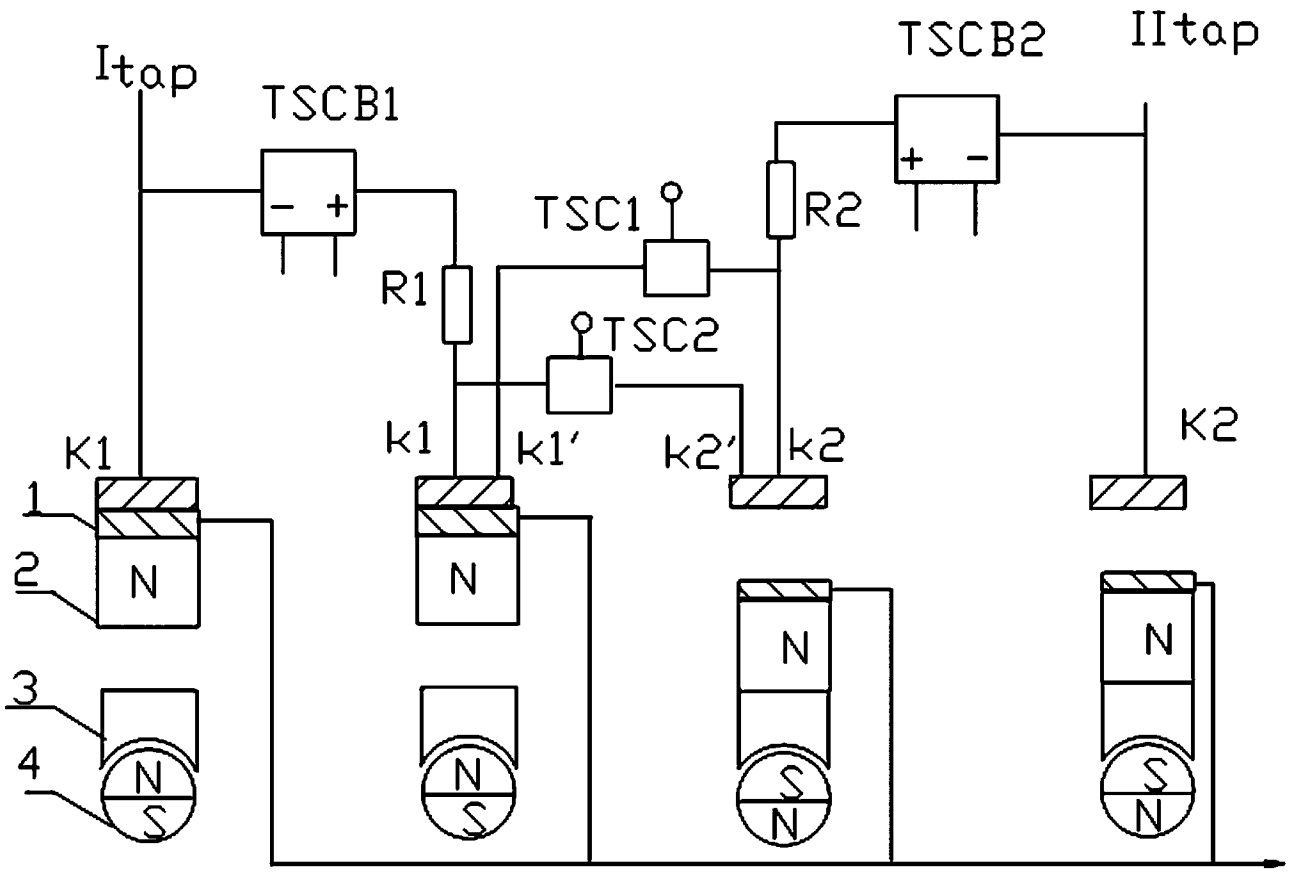
FIG. 4 is the schematic diagram of contacting of the moving contactor D1 with the working contactor K1, and the contacting of the moving contactor D2 with the dual-contact synchronous transition contactors k1, k1' in Embodiment 1.
Figure 5:
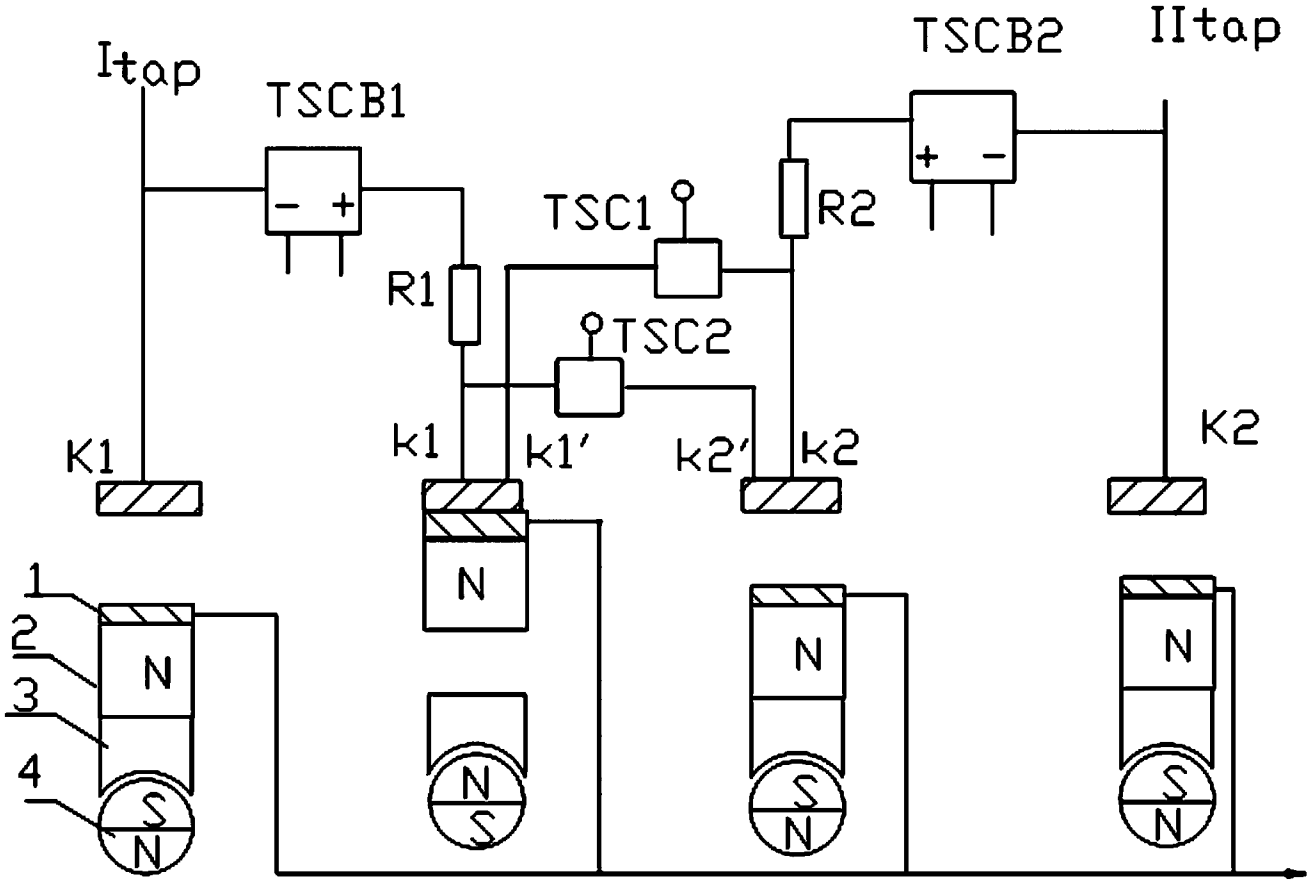
FIG. 5 is the schematic diagram of contacting of the moving contactor D2 with the dual-contact synchronous transition contactors k1, k1' in Embodiment 1.
Figure 6:
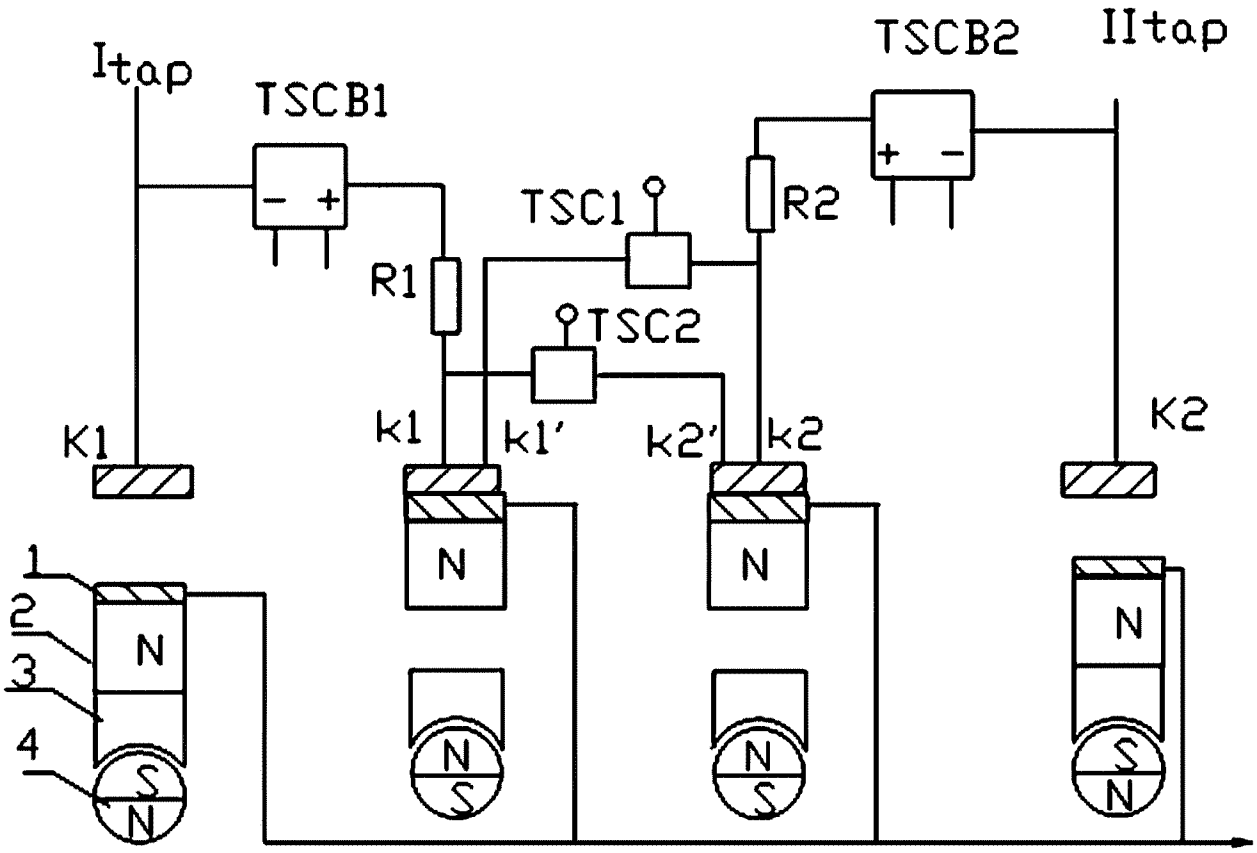
FIG. 6 is the schematic diagram of contacting of the moving contactor D2 with the dual-contact synchronous transition contactors k1, k1', and the contacting of the moving contactor D3 with the dual-contact synchronous transition contactors k2, k2' in Embodiment 1.
Figure 7:
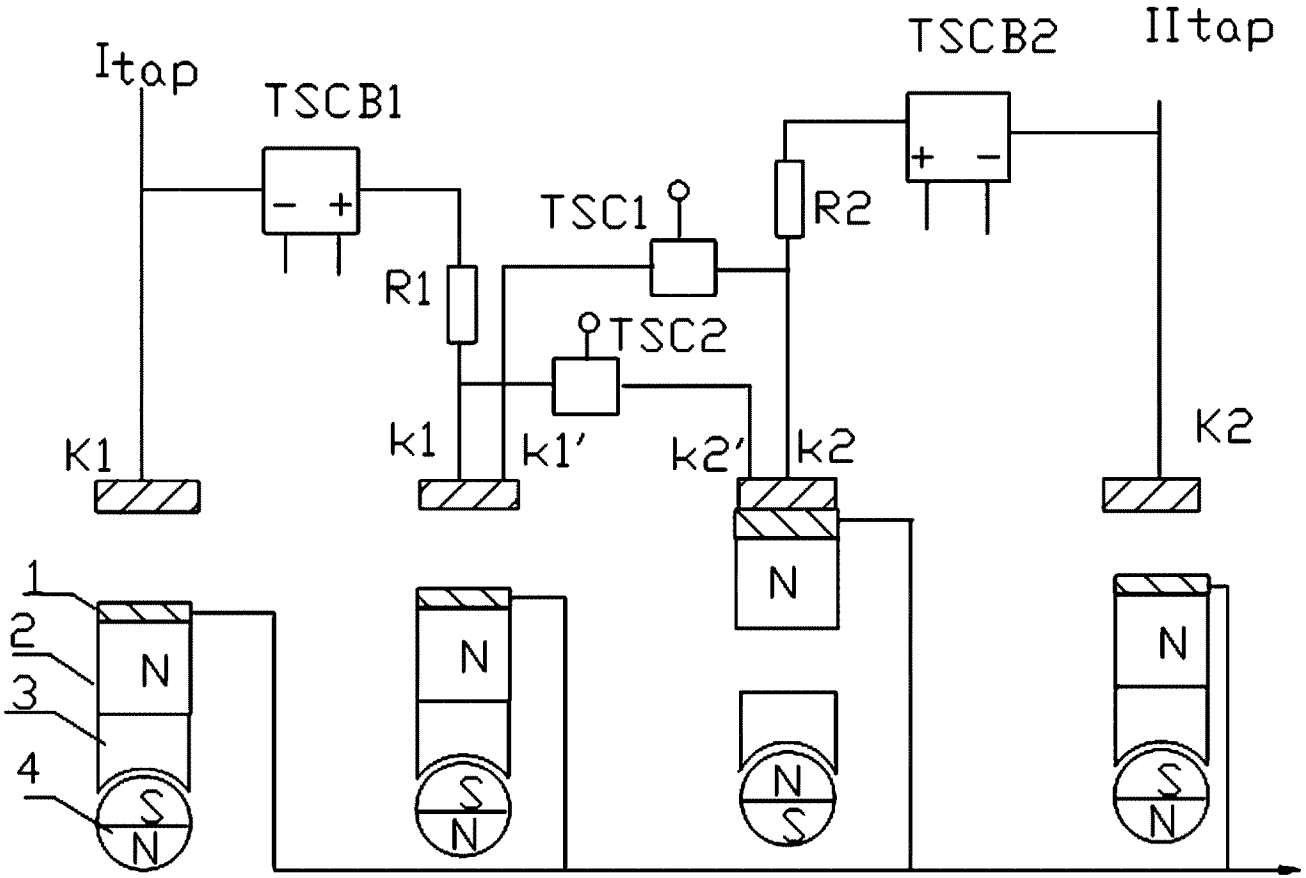
FIG. 7 is the schematic diagram of contacting of the moving contactor D3 with the dual-contact synchronous transition contactors k2, k2' in Embodiment 1.
Figure 8:
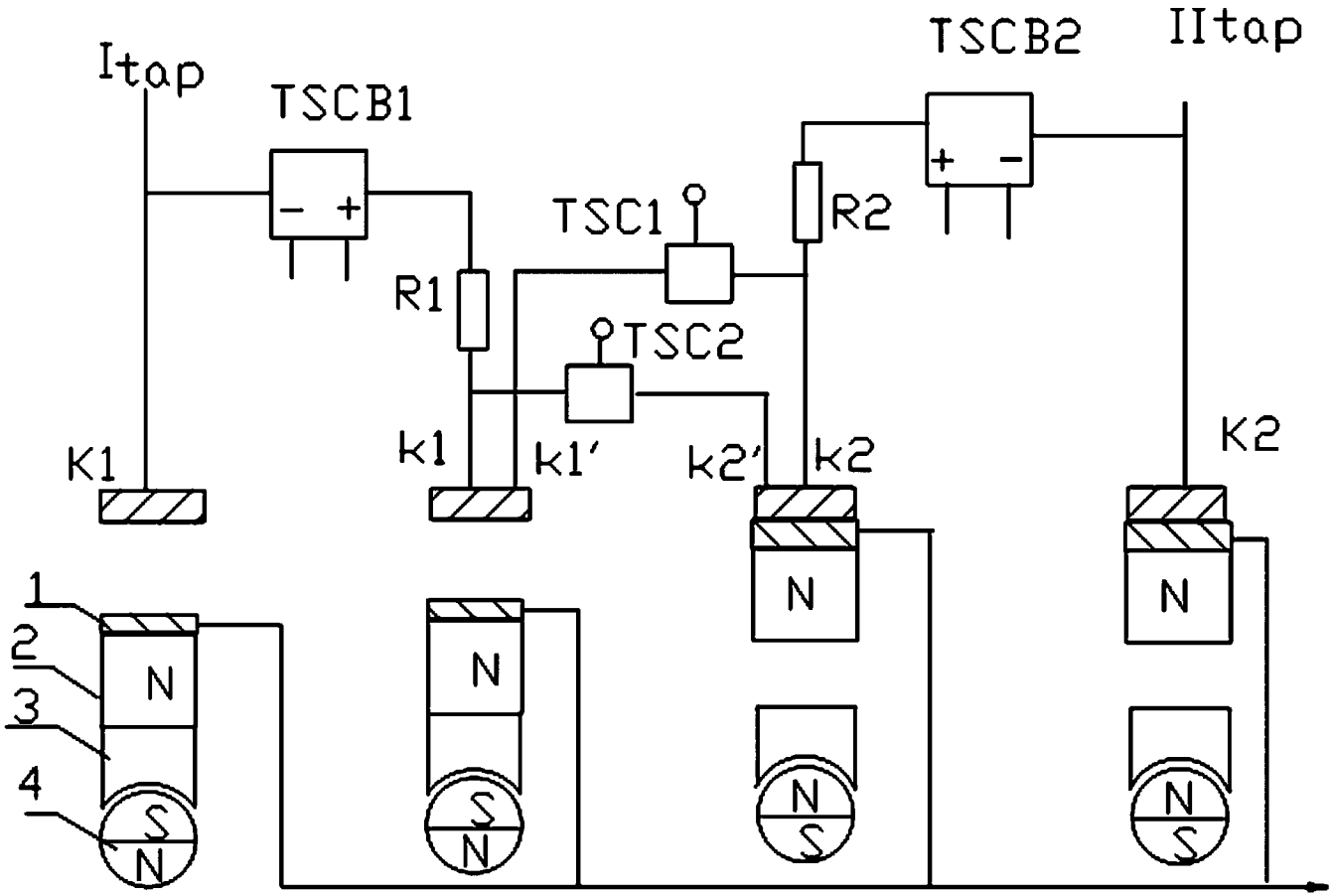
FIG. 8 is the schematic diagram of contacting of the moving contactor D4 with the working contactor K2, and the contacting of the moving contactor D3 with the dual-contact synchronous transition contactors k2, k2' in Embodiment 1.
Figure 9:
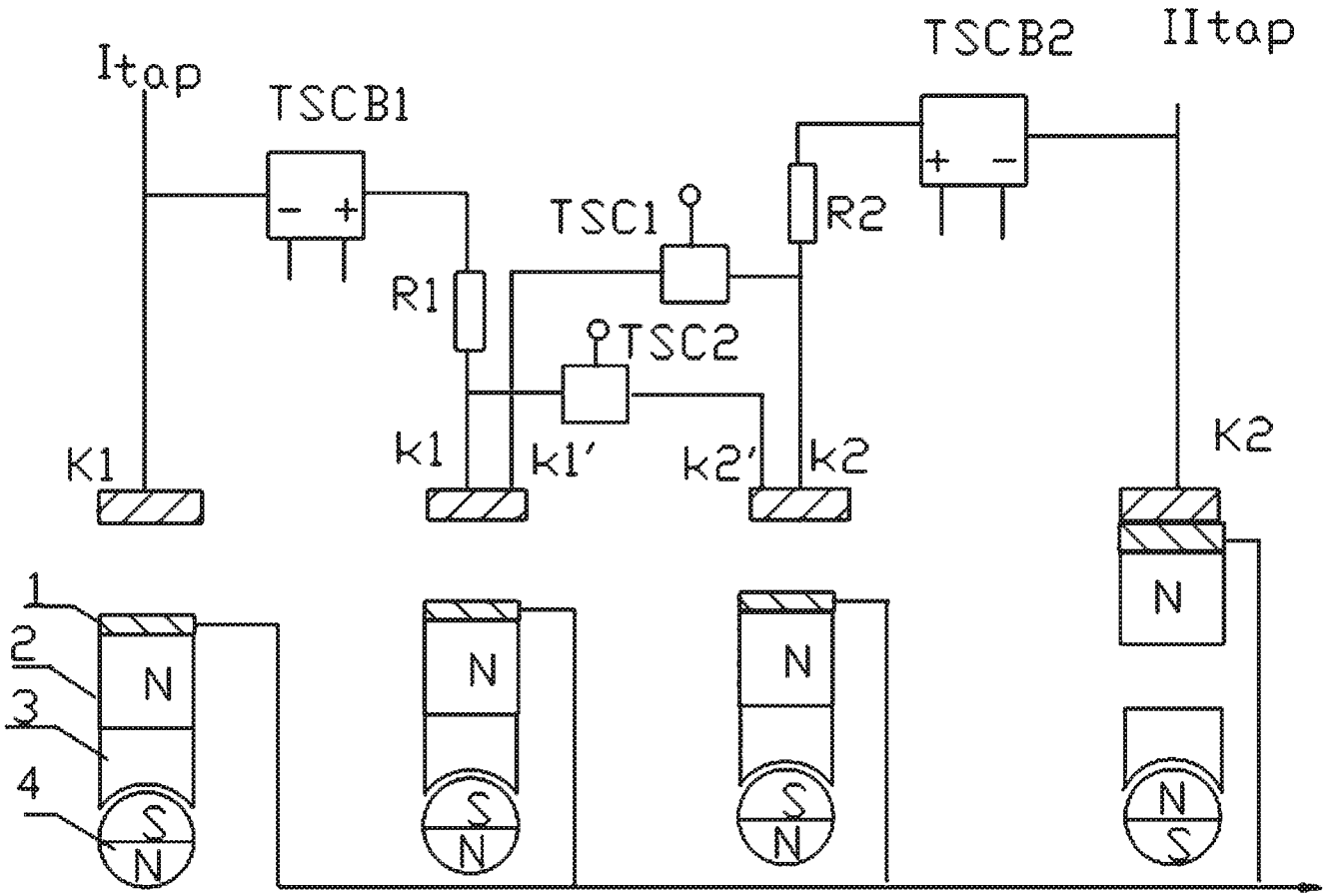
FIG. 9 is the schematic diagram of contacting of the moving contactor D4 with the working contactor K2 in Embodiment 1.

As shown in FIG. 3 to FIG. 9, the process that the moving contactor 1 switches from the working contactor K1 to the working contactor K2 is as follows:

As shown in FIG. 3, the moving contactor D1 contacts with the working contactor K1, while the trigger transmitter TSCB1 and the trigger transmitter TSCB2 have no current;

As shown in FIG. 4, the moving contactor D1 contacts with the working contactor K1, the moving contactor D2 contacts with the dual-contact synchronous transition contactors k1, k1', while the trigger transmitter TSCB1 and the trigger transmitter TSCB2 have no current;

As shown in FIG. 5, the moving contactor D2 contacts with the dual-contact synchronous transition contactors k1, k1', while the trigger transmitter TSCB1 and the trigger transmitter TSCB2 have current;

As shown in FIG. 6, the moving contactor D2 contacts with the dual-contact synchronous transition contactors k1, k1', the moving contactor D3 contacts with the dual-contact synchronous transition contactors k2, k2', while the trigger transmitter TSCB1 and the trigger transmitter TSCB2 have current, and they are liable to produce electric arcs;

As shown in FIG. 7, the moving contactor D3 contacts with the dual-contact synchronous transition contactors k2, k2', while the trigger transmitter TSCB1 and the trigger transmitter TSCB2 have current;

As shown in FIG. 8, the moving contactor D4 contacts with the working contactor K2, the moving contactor D3 contacts with the dual-contact synchronous transition contactors k2, k2', while the trigger transmitter TSCB1 and the trigger transmitter TSCB2 have no current;

As shown in FIG. 9, the moving contactor D4 contacts with the working contactor K2, while the trigger transmitter TSCB1 and the trigger transmitter TSCB2 have no current.

The normal work can be guaranteed even in the event of no timely overhaul when the following failures occur:

(1) When the high-voltage thyristor TSC1 is open-circuit, the working contactor K1 and the working contactor K2 will have striking of arc and extinction of arc;

(2) When the high-voltage thyristor TSC2 is open-circuit, the working contactor K1 and the working contactor K2 will have striking of arc and extinction of arc;

(3) When the high-voltage thyristor TSC1 is short-circuited turn-on, the dual-contact synchronous transition contactors k1, k1' will have striking of arc and extinction of arc;

(4) When the high-voltage thyristor TSC2 is short-circuited turn-on, the dual-contact synchronous transition contactors k2, k2' will have striking of arc and extinction of arc.

Embodiment 2

Figure 2:
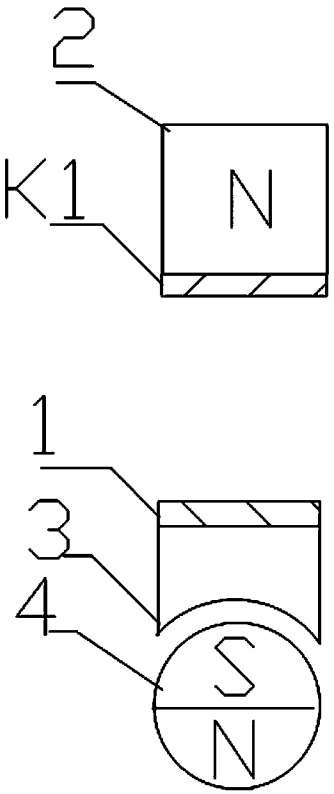
FIG. 2 is the schematic diagram of working principle of Embodiment 2.

A permanent magnet drive on-load tap-changing switch, as shown in FIG. 2, comprising a changing switch circuit, wherein the said changing switch circuit comprises an odd-numbered tap-changing circuit and an even-numbered tap-changing circuit that are structurally identical, wherein the tap-changing circuits are constituted by working contactors K1/K2, and dual-contact synchronous transition contactors k1, k1'/k2, k2' consisting of primary contactors k1/k2 and secondary contactors k1'/k2', and the working contactor K1/K2 is connected with the primary contactor k1/k2 by trigger transmitter TSCB1/TSCB2 and transition resistance R1/R2, the primary contactor k1 of the odd-numbered tap-changing circuit is connected to the secondary contactor k2' of the even-numbered tap-changing circuit by the high-voltage thyristor TSC2; the primary contactor k2 of even-numbered tap-changing circuit is connected to the secondary contactor k1' of the odd-numbered tap-changing circuit by the high-voltage thyristor TSC1. The said trigger transmitter TSCB1 provides the high-voltage thyristor TSC1 with trigger current; the said trigger transmitter TSCB2 provides the high-voltage thyristor TSC2 with trigger current. The said working contactor K1/K2 and the said dual-contact synchronous transition contactors k1, k1'/k2, k2' are connected to a permanent magnet 2 on one side, while they are directly face to a moving contactor 1 on the other side, and the moving contactors 1 are connected in parallel to each other, while each moving contactor 1 is connected to the moving contactor driving mechanism. Wherein the working contactor driving mechanism changes a force applied to the permanent magnets and thereby allowing the moving contactors 1 to come into contact with or be separated from the working contactors K1/K2 and the dual-contact synchronous transition contactors k1, k1'/k2, k2', thus implementing changeover from one tap to another tap. The moving contactor driving mechanism comprises a rotating permanent magnet 4 and a magnetic conductor 3 of which head pole is enveloped on one side of the rotating permanent magnet 4, while the tail pole of magnetic conductor 3 is directly face to the permanent magnet 2.

The work process is the same as that of Embodiment 1, so it is not repeated here.

The invention claimed is:

1. A permanent magnet drive on-load tap-changing switch, comprising:

a changing switch circuit comprising an odd-numbered tap-changing circuit and an even-numbered tap-changing circuit that are structurally identical, each of the tap-changing circuits being constituted by (i) a working contactor and (ii) a dual-contact synchronous transition contactor consisting of a primary contactor, which is connected with the working contactor by a trigger transmitter and a transition resistor, and a secondary contactor, wherein:

the primary contactor of one of the tap-changing circuits is connected to the secondary contactor of another of the tap-changing circuits by a high-voltage thyristor, the trigger transmitter of one of the tap-changing circuits provides a high-voltage thyristor connected to the secondary contactor of the same tap-changing circuit with trigger current, the working contactors and the dual-contact synchronous transition contactors respectively correspond to moving contactors, that are connected in parallel to each other, permanent magnets are fixed bijectively on the moving contactors, each of the permanent magnets facing directly at another extremity thereof a moving contactor driving mechanism, and the moving contactor driving mechanisms change a force applied to the permanent magnets and thereby allow the moving contactors to come into contact with or be separated from the working contactors and the transition contactors, thus implementing changeover from one tap to another tap.

2. The permanent magnet drive on-load tap-changing switch according to claim 1, wherein each of the moving contactor driving mechanisms comprises a rotating permanent magnet and a magnetic conductor, a head pole of the magnetic conductor enveloping one side of the rotating permanent magnet and a tail pole of the magnetic conductor directly facing the permanent magnet.

* * * * *